US008454111B2

(12) United States Patent
Hayashi et al.

(10) Patent No.: US 8,454,111 B2
(45) Date of Patent: Jun. 4, 2013

(54) PRINTING APPARATUS AND OBJECT CONVEYANCE CONTROL METHOD

(75) Inventors: Masashi Hayashi, Sagamihara (JP); Jiro Moriyama, Kawasaki (JP); Hiroyuki Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 397 days.

(21) Appl. No.: 12/488,127

(22) Filed: Jun. 19, 2009

(65) Prior Publication Data

US 2009/0322819 A1 Dec. 31, 2009

(30) Foreign Application Priority Data

Jun. 27, 2008 (JP) ..... 2008-169047

(51) Int. Cl.
*B41J 29/38* (2006.01)

(52) U.S. Cl.
USPC ..... 347/14; 347/16; 400/582

(58) Field of Classification Search
USPC ..... 347/5, 9, 16, 19, 14; 400/582
See application file for complete search history.

(56) References Cited

U.S. PATENT DOCUMENTS

| | | | | |
|---|---|---|---|---|
| 5,149,980 | A | 9/1992 | Ertel et al. | 250/561 |
| 5,580,042 | A | 12/1996 | Taniguro et al. | 271/274 |
| 5,589,858 | A * | 12/1996 | Kadowaki et al. | 347/14 |
| 5,672,019 | A | 9/1997 | Hiramatsu et al. | 400/624 |
| 5,725,319 | A | 3/1998 | Saito et al. | 400/629 |
| 5,918,873 | A | 7/1999 | Saito et al. | 271/10.11 |
| 6,168,270 | B1 | 1/2001 | Saikawa et al. | 347/104 |
| 6,305,682 | B1 | 10/2001 | Saito et al. | 271/10.11 |
| 6,599,042 | B2 * | 7/2003 | Wolf | 400/582 |
| 6,805,425 | B2 * | 10/2004 | Hayashi et al. | 347/16 |
| 6,834,177 | B2 | 12/2004 | Saito et al. | 399/313 |
| 6,939,064 | B2 | 9/2005 | Kawaguchi et al. | 400/283 |
| 7,104,710 | B2 | 9/2006 | Otsuka | 400/76 |
| 7,448,715 | B2 * | 11/2008 | Nakayama | 347/19 |
| 2005/0053408 | A1 | 3/2005 | Otsuka | |
| 2005/0128236 | A1 | 6/2005 | Fukasaka | |
| 2007/0236545 | A1 | 10/2007 | Baker et al. | |

FOREIGN PATENT DOCUMENTS

| | | | |
|---|---|---|---|
| EP | 1063096 | | 12/2000 |
| JP | 08-292264 | A | 11/1996 |
| JP | 2002-179290 | A | 6/2002 |
| JP | 2003-267591 | A | 9/2003 |
| JP | 2006-159895 | A | 6/2006 |
| JP | 2006-347045 | A | 12/2006 |
| WO | 2007/046309 | A1 | 4/2007 |

OTHER PUBLICATIONS

Russian Decision on Grant dated Sep. 3, 2010, issued in counterpart Russian patent application No. 2009124527/12(0033977), with an English translation. European Official Action, dated Jul. 23, 2010, issued in European Patent Application No. 09162237.3.
Japanese Office Action, dated Oct. 16, 2012, issued by the Japanese Patent Office, in Japanese Patent Application No. 2008-169047.
Japanese Office Action, dated Jan. 29, 2013, issued by the Japanese Patent Office, in Japanese Application No. 2008-169047.

* cited by examiner

*Primary Examiner* — Lam S Nguyen
(74) *Attorney, Agent, or Firm* — Fitzpatrick, Cella, Harper & Scinto

(57) ABSTRACT

A printing apparatus and a conveyance control method are provided, both capable of detecting a print medium conveying state highly precisely in an entire process of conveying the print medium being printed. For this purpose, the surface of the print medium placed on the belt and the surface of the belt are detected to acquire the moving distance or moving speed of the print medium. Based on the moving distance or moving speed thus obtained, the driving of the belt is controlled. Even in a situation where the object being detected switches from the print medium to the belt in the middle of the conveying operation, the measurement of the moving distance can be performed without interruption by the same detection method using the same optical sensor unit.

12 Claims, 14 Drawing Sheets

PRINTING APPARATUS AND OBJECT CONVEYANCE CONTROL METHOD

BACKGROUND OF THE INVENTION

1. Field of the Invention

The present invention relates to a printing apparatus that prints an image on an object, such as a print medium, while conveying the object relative to a print head and also to a method of controlling a conveyance of an object such as a print medium. Particularly the present invention relates to a construction and a method for detecting a distance that the object, such as print medium, has traveled and a speed of the object with high precision.

2. Description of the Related Art

In a printing apparatus that prints an image on a print medium using a print head while moving a print medium, to print a high-quality image with higher precision calls for raising a print medium conveyance precision. For example, U.S. Pat. Nos. 5,149,980 and 7,104,710 disclose a technology to optically measure the actual distance traveled by the print medium.

FIG. 1 shows an apparatus, disclosed in U.S. Pat. No. 7,104,710. The apparatus disclosed in U.S. Pat. No. 7,104,710 has two measuring means a means to measure the real rotational amount of a conveying roller that conveys the print medium and a means to measure the real distance traveled by the print medium.

In FIG. 1, a print medium 107 is held between conveying rollers 101, 102 and opposing two pinch rollers 103, 104 and conveyed by the rotation of the conveying rollers 101, 102 in a Y direction. A rotating force of the conveying rollers 101, 102 is produced by a drive shaft of a conveying motor 108 engaging the two conveying rollers. A code wheel 105 is secured on the same rotary axis as the conveying roller 101.

A rotation angle sensor 106, installed at a position where a circumferential portion of the code wheel 105 passes, can measure the rotational amount of the code wheel 105. From the rotational amount of the code wheel 105, i.e., the rotational amount of the conveying roller 101, the distance traveled by the print medium 107 can be determined.

It is noted, however, that the rotation angle of the conveying roller does not necessarily match the actual distance that the print medium was conveyed. An eccentricity of the conveying roller that may occur during its installation and a slip between the conveying roller and the print medium unavoidably cause some shifts or deviations between the distance traveled by the print medium and the rotation angle of the conveying roller. To avoid this problem, U.S. Pat. No. 7,104,710 discloses a construction which has, in addition to the rotation angle sensor 106, an optical sensor 701 that measures the actual distance traveled by the print medium 107 and performs the print medium conveyance control based on conveyance information from the two sensors.

In the example shown, the optical sensor 701 is mounted on a carriage 200 along with a head cartridge 100 and disposed between the two conveying rollers 101, 102. The optical sensor 701 captures states of a surface of the print medium being conveyed as image information at a plurality of timings. From the plurality of pieces of image information thus captured, a control unit of the printing apparatus calculates the distance traveled by the print medium and the conveying speed of the print medium. As described above, the provision of a means to directly detect the conveying distance and speed of the print medium and the driving of the conveying means according to the information obtained allow the printing position of an image on the print medium to be controlled more precisely.

It is noted, however, that even if a means to directly detect the conveying distance of a print medium is provided, as in U.S. Pat. Nos. 5,149,980 and 7,104,710, the conveying speed cannot be detected at timings at which the print medium is outside a detectable range of the optical sensor, such as at an initial or final stage of the conveying operation.

Take for example a case where the optical sensor 701 is used, as shown in FIG. 1. At an initial stage of the conveying operation until the print medium 107 comes under the optical sensor 701, the distance traveled by the print medium 107 cannot be measured. As a result, when a front part of the print medium is printed, the information from the optical sensor 701 cannot be reflected on the driving of the conveying motor 108, giving rise to a possibility that the printing position of the front part of the print medium may not be controlled precisely.

SUMMARY OF THE INVENTION

The present invention has been accomplished to solve the above-mentioned problem and its objective is to provide a printing apparatus and a medium conveyance control method, both capable of detecting with high accuracy the distance that the print medium is conveyed and precisely controlling the conveyance of the print medium.

The first aspect of the present invention is a printing apparatus for printing an image on a print medium, comprising: a belt capable of holding the print medium thereon; a drive mechanism configured to move the belt while printing; a detecting unit configured to detect a moving distance or a speed of the print medium held on the belt, the detecting unit being capable of capturing both a surface image of the belt and a surface image of the print medium held on the belt, and the detecting unit acquires the moving distance or the speed by image processing; and a control unit configured to control the drive mechanism based on detection output of the detecting unit.

The second aspect of the present invention is a method of controlling the conveyance of an object placed on a moving belt A method of controlling the conveyance of an object placed on a moving belt, comprising: a first step to move the belt on which the object is placed; a second step to detect a moving distance or a speed of the object by capturing a surface image of the object placed on the belt and a surface image of the belt sequentially; and a third step to control the movement of the belt in the first step based on the moving distance or the speed acquired by the second step.

The above and other objects, effects, features and advantages of the present invention will become more apparent from the following description of embodiments thereof taken in conjunction with the accompanying drawings.

Further features of the present invention will become apparent from the following description of exemplary embodiments (with reference to the attached drawings).

DESCRIPTION OF THE EMBODIMENTS (First Embodiment)

Figure 1:
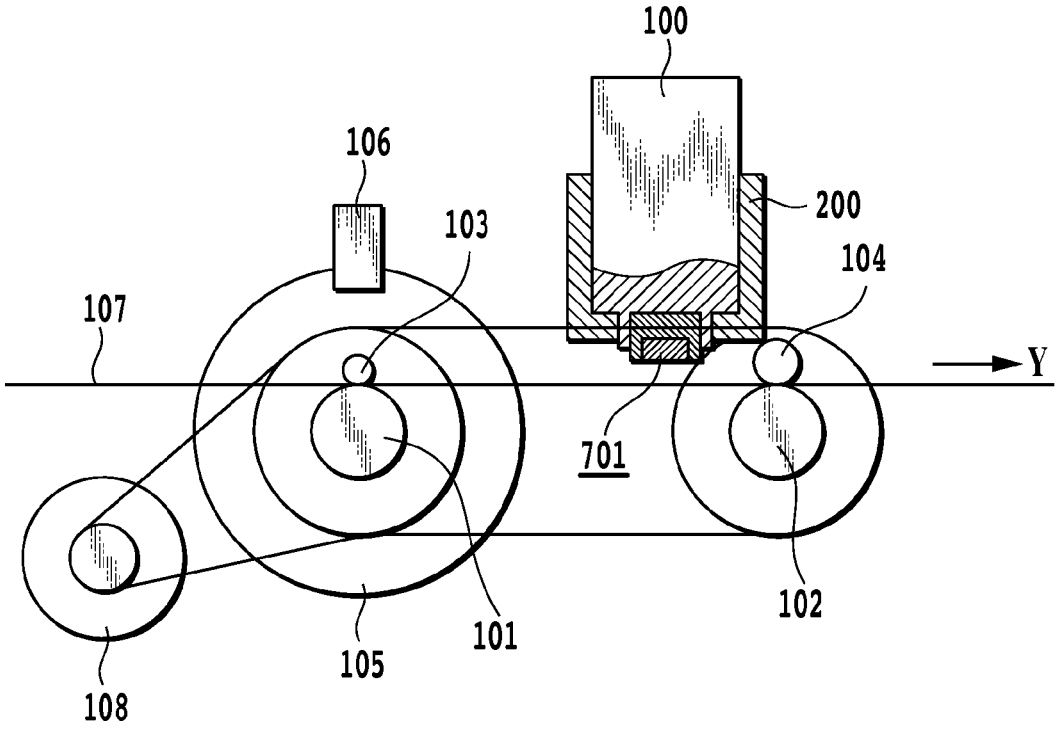
FIG. 1 is a schematic diagram showing the method of measuring the distance traveled by the print medium, as disclosed in U.S. Pat. No. 7,104,710.
Figure 2:
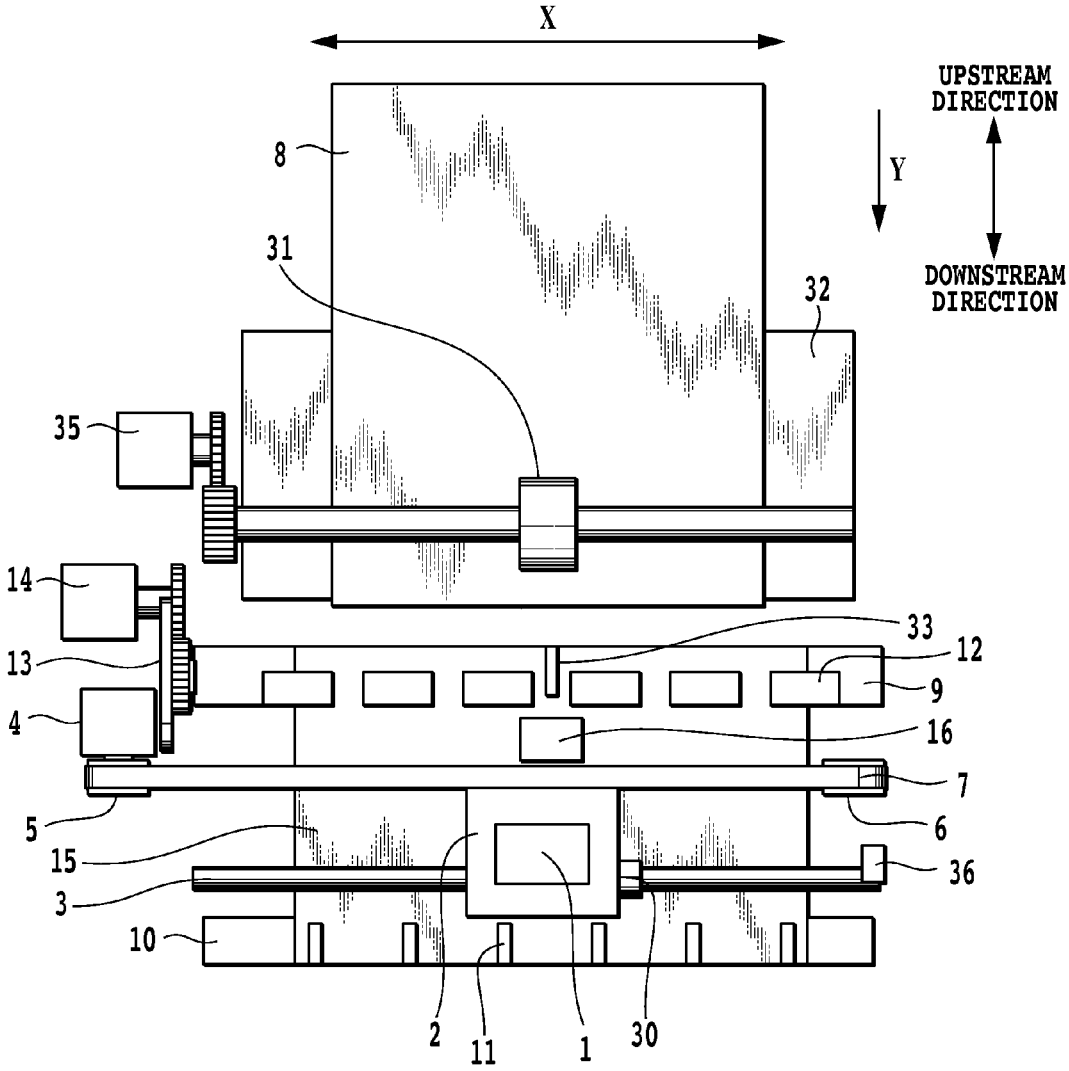
FIG. 2 is a schematic view, as seen from above, showing a construction of a main part of the ink jet printing apparatus applicable to this invention.
Figure 3:
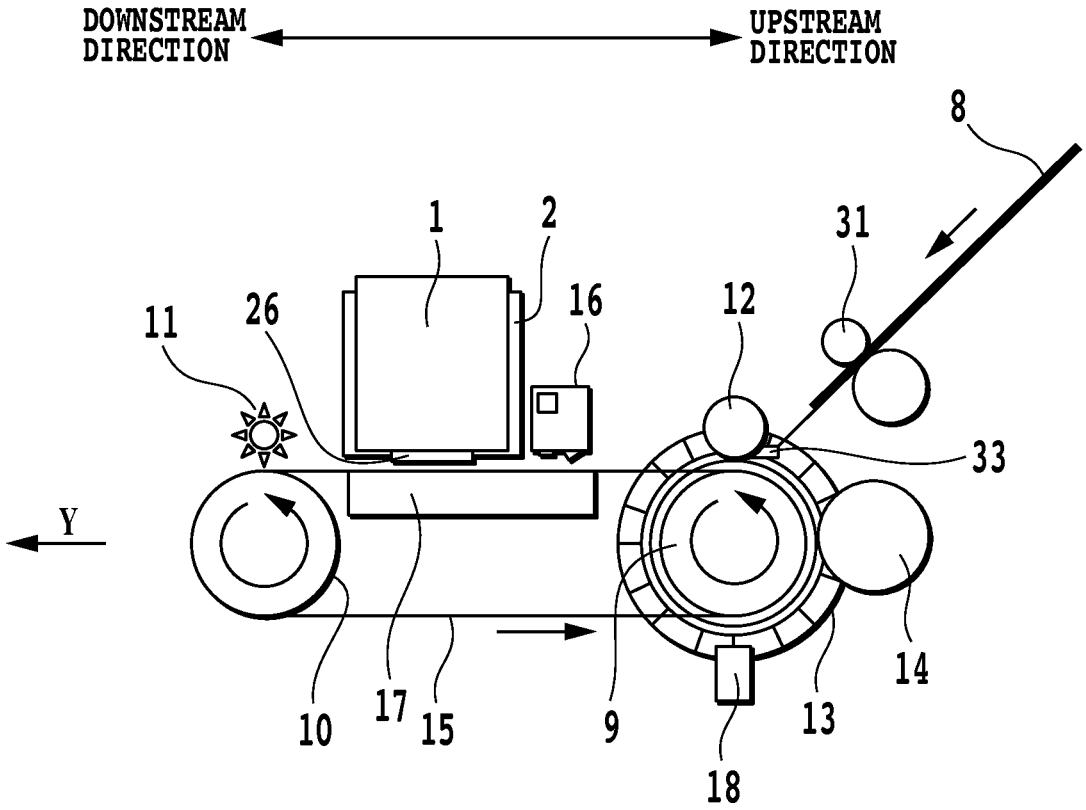
FIG. 3 is a cross-sectional view showing details of a printing unit and a conveying system of the ink jet printing apparatus applicable to this invention.

FIG. 2 is a top view of a main part of the ink jet printing apparatus applicable to this invention. FIG. 3 is a cross-sectional view showing details of a printing unit and a conveying system in the printing apparatus.

Before the printing operation is performed, a print medium 8, such as plain paper and plastic thin sheets, is placed on an auto sheet feeder 32. When the printing operation is started, a paper supply motor 35 is operated to drive a pickup roller 31 through gears. As the pickup roller 31 is rotated, the print medium 8 is taken and separated, one sheet at a time, from the auto sheet feeder 32 and supplied into the interior of the printing apparatus. At this time, a paper sensor 33 detects the presence or absence of the print medium 8 to determine whether or not the paper supply is normally performed. The print medium 8 thus supplied is placed on a belt 15 and carried in a Y direction at a predetermined speed.

As shown in FIG. 3, the belt 15 is held around the conveying roller 9 and a follower roller 10 so that it is in contact with their outer circumferences. The follower roller 10 is urged in a downstream direction (to the left of the figure) by a spring member not shown to keep the tension of the belt 15 constant. The rotation force of a conveying motor 14 is transmitted through gears to the conveying roller 9 whose rotating motion is transmitted to the belt, causing the belt 15 and the follower roller 10 to rotate in the directions shown. The print medium 8 that was fed to the position of the conveying roller 9 is carried in the Y direction by the rotation of the belt 15.

The conveying roller 9 is mounted with a code wheel 13 so that their rotation axes are the same. A rotation angle sensor 18 is arranged to detect the rotation position of the code wheel 13.

Figure 4:
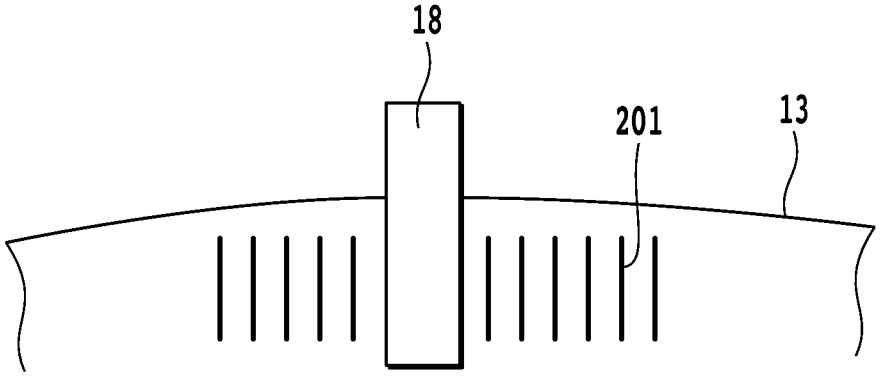
FIG. 4 is a schematic diagram showing a code wheel and a rotation angle sensor as they are installed.

FIG. 4 is a schematically diagram which shows the code wheel 13 and the rotation angle sensor 18 as they are installed. The code wheel 13 has slits 201 cut at equal intervals in its circumferential portion, and the rotation angle sensor 18 is installed at a position where the slits 201 pass. The rotation angle sensor 18 is of an optical transmission type and detects the moving slits 201 and generates a pulse signal as it detects them. This pulse signal allows the rotational amount of the code wheel 13 to be detected. From the time interval at which the pulse signal is generated, the position and the conveying speed of the print medium can be calculated. That is, this embodiment has a means to detect a drive amount of the conveying roller such as the code wheel 13 and the rotation angle sensor 18, and based on the information obtained from the drive amount detection means, indirectly calculates the conveying distance and speed of the print medium.

Referring again to FIG. 2 and FIG. 3. At a position of the belt 15 that faces a head cartridge 1, a platen 17 made of a flat plate is disposed to support the belt 15 from inside. Upstream and downstream of the print area of the head cartridge 1 there are provided a pinch roller 12 and a spur roller 11 to hold down the print medium 8 being conveyed. The print area of the print medium 8 being conveyed is kept flat by the platen 17 supporting it from below and by the pinch roller 12 and the spur roller 11 pressing it from above.

A carriage 2 is supported and guided on a guide shaft 3 installed in the printing apparatus and is allowed to move reciprocally in an X direction in which the guide shaft 3 extends. The moving force of the carriage 2 is produced as the drive force of the carriage motor 4 is transmitted to a motor pulley 5, a follower pulley 6 and a timing belt 7. The carriage 2 is provided with a home position sensor 30. That the carriage 2 is at the home position can be detected when the home position sensor 30 moves past a shield plate 36 installed at the home position.

The head cartridge 1 mounted on the carriage 2 has a print head 26 to eject ink and an ink tank that supplies ink to the print head 26. The print head 26 ejects ink at a predetermined timing according to an image signal onto the print medium 8 being conveyed below as it moves in the X direction along with the carriage 2.

Figure 5:
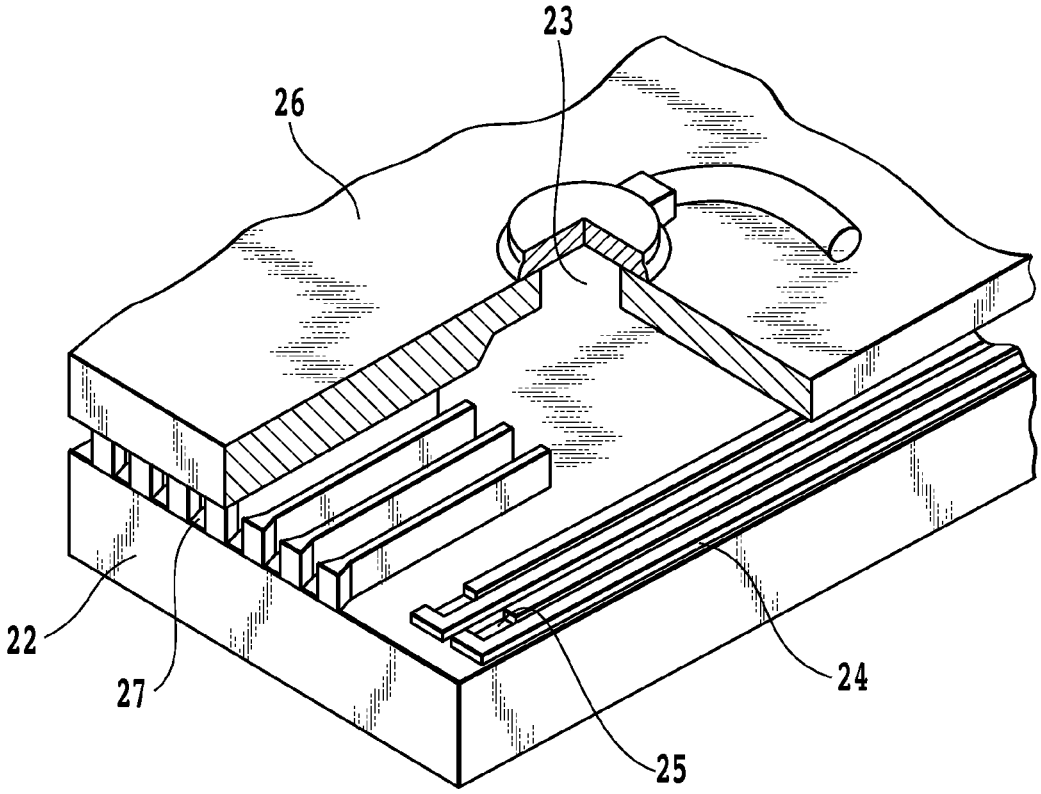
FIG. 5 is a schematic perspective view showing a part of structure of a print head.

FIG. 5 is a schematic perspective view showing a part of the structure of the print head 26. The print head 26 used in this embodiment has a plurality of electrothermal transducing element to generate thermal energy and ejects ink by the generated thermal energy. In the figure, an ejection opening face 22 of the print head 26 that faces the print medium 8 with a predetermined gap in between is formed with a plurality of ejection openings 27 at a predetermined pitch. Ink supplied from the ink tank is temporarily accommodated in a common chamber 23 and then led by a capillary attraction into a plurality of ink paths 24 communicating with the individual ejection openings 27. At a portion inside each of the ink paths 24 that is close to the ejection opening 27, the electrothermal transducing element 25 to generate thermal energy is installed. The electrothermal transducing element 25 is applied a predetermined pulse based on an image signal to generate heat, which causes a film boiling in the ink in the ink paths 24. The pressure of an expanding bubble expels a predetermined volume of ink as a droplet from the ejection openings 27.

The printing apparatus used in this embodiment is a serial type ink jet printing apparatus which has the ejection openings 27 arrayed in a direction crossing the X direction in which the carriage 2 travels. That is, a printing scan, which ejects ink from the ejection openings 27 while moving the carriage 2, and a conveying operation, which conveys the print medium a predetermined distance in the Y direction by rotating the belt 15, are alternately repeated to progressively form an image on the print medium 8.

Returning again to FIG. 2 and FIG. 3. In this embodiment, an optical sensor unit 16 to directly detect the conveying distance of the print medium 8 is installed upstream of the print head 26 on the carriage 2 (upstream of the printing area) in the conveying direction (Y direction).

Figure 6:
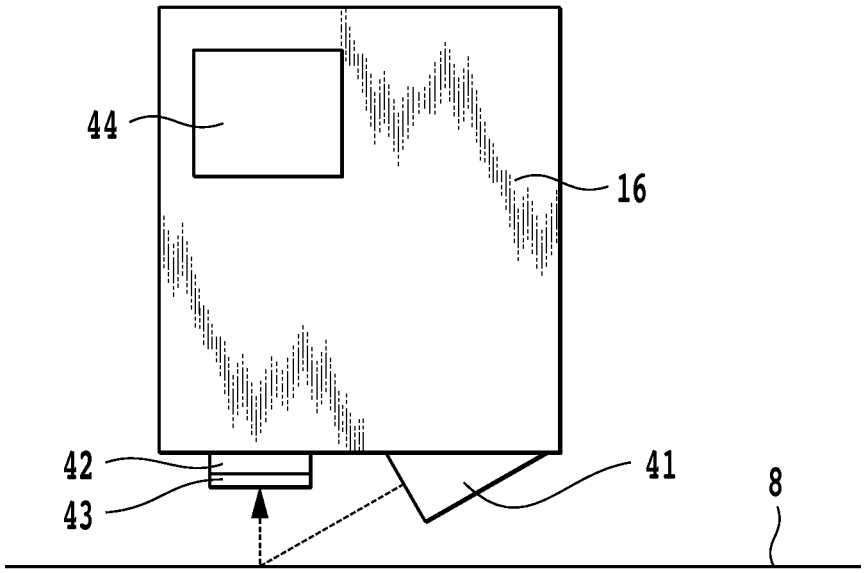
FIG. 6 is a schematic diagram showing an outline construction of an optical sensor unit.

FIG. 6 is a schematic diagram showing an outline construction of the optical sensor unit 16. The optical sensor unit 16 has a light emitting element 41 and a light receiving element 42. The light receiving element 42 receives light emitted from the light emitting element 41 and reflected by the print medium 8 through a lens system 43. The light receiving element 42 is an image capturing device such as a CCD device and a CMOS device. The image capturing device may use a line sensor having optoelectronic conversion elements arranged one-dimensionally or an area sensor having these conversion elements arranged two-dimensionally. The image capturing area of the optical sensor unit 15 (image capturing device) is on the belt surface of the belt 15 where the print medium 8 on the belt passes through at least while printing. Image information captured by the light receiving element 42 is sent to hardware 44 where it is subjected to predetermined processing, before being transferred to the controller of the printing apparatus.

The image information captured here is information from the reflected light that features the partial surface state of the print medium 8 and the belt 15. For example, the information may be a shade produced by the surface geometry of the print medium 8 and the belt 15, or a pattern printed on their surfaces in advance. It may also be a speckle pattern produced by the interference of reflected light from a coherent light source.

Figure 7:
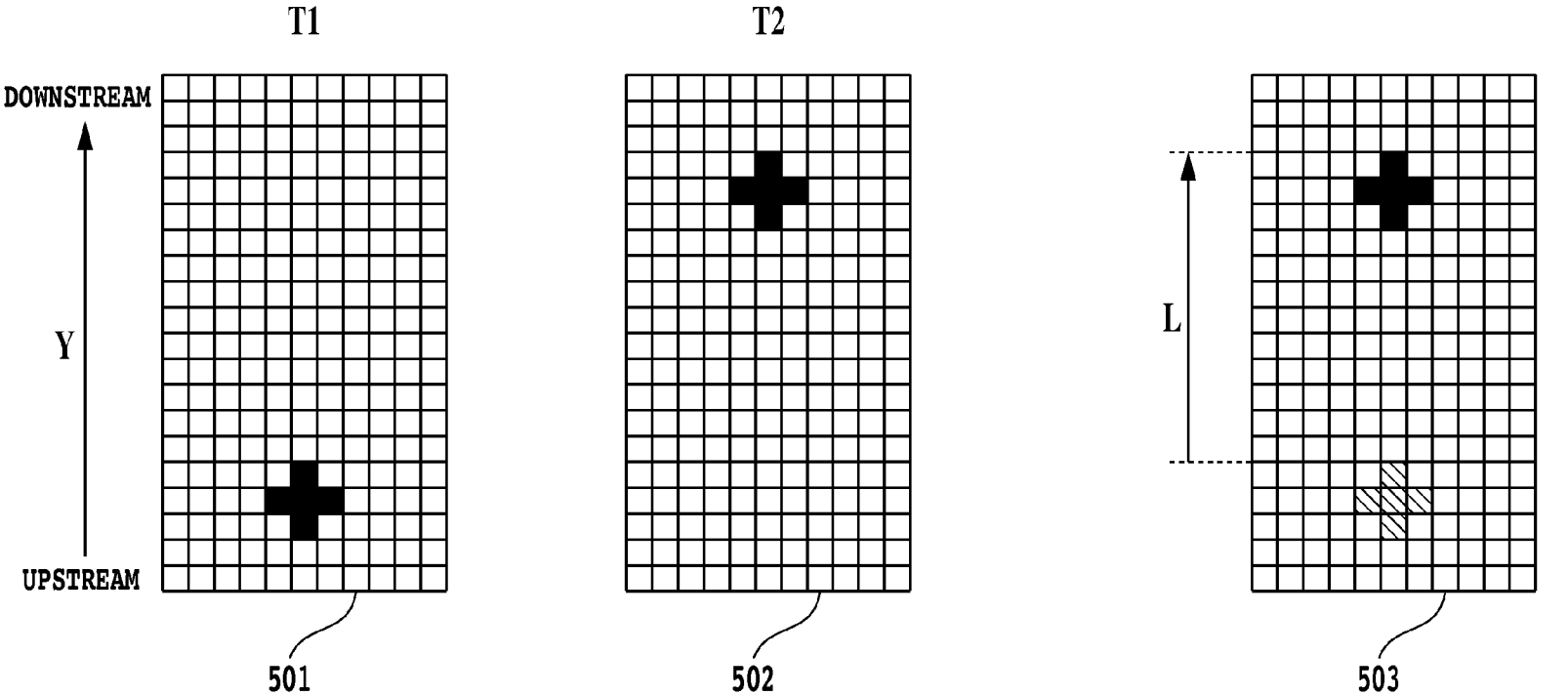
FIG. 7 is diagrams showing a method of determining the conveying distance and speed of the print medium from the image information obtained by the optical sensor unit at two different timings T1 and T2.

FIG. 7 shows the method of determining the conveying distance and/or the conveying speed of the print medium 8 by image processing. In the image processing, the image information obtained from the optical sensor unit 16 at two different timings T1 and T2 are used. Denoted 501 is first image information obtained by the optical sensor unit 16 detecting the surface within the image capturing area of the print medium being conveyed at time T1. Once the first image information is obtained, the controller in the printing apparatus puts a correlated window region 601 of a predetermined size on the image information 501.

Figure 8:
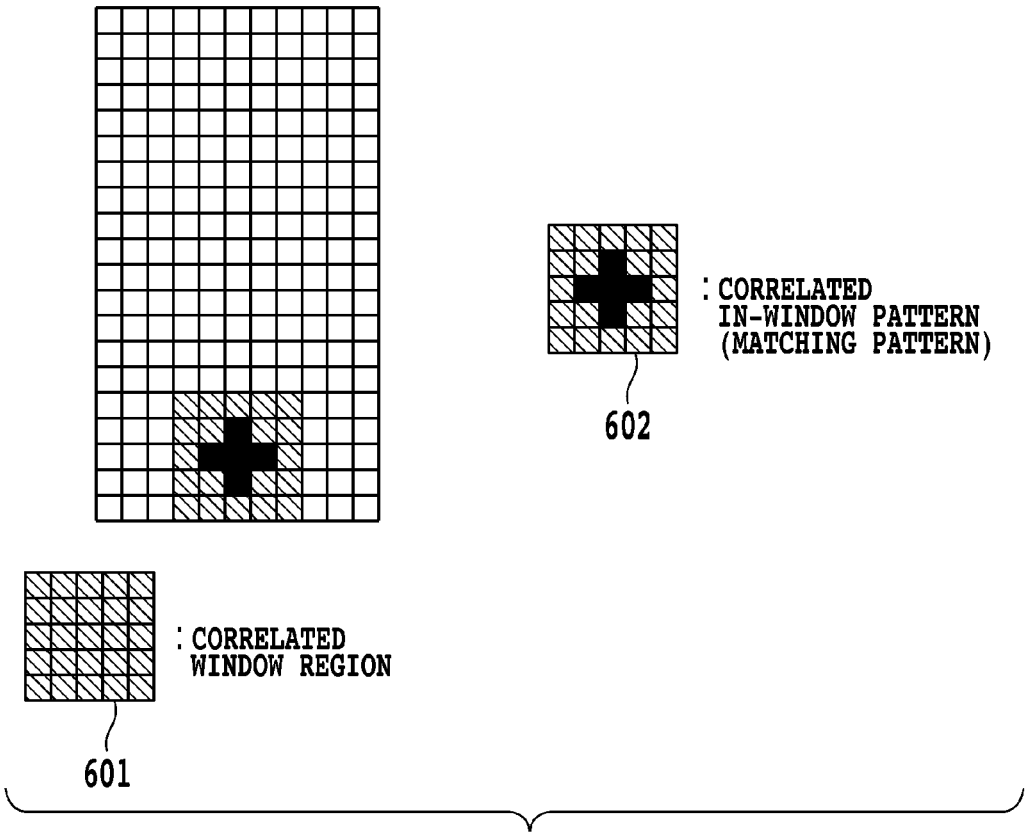
FIG. 8 is a schematic diagram showing how a correlated window region for image information is arranged.

FIG. 8 is a schematic diagram showing how the correlated window region 601 is placed on the image information 501. In this embodiment, the correlated window region 601 has an area of 5×5 pixels and is placed on the first image information 501 so that a feature pattern (cross pattern) printed on the print medium 8 comes at the center of the window. Then, the controller extracts only the image information included in the correlated window region 601 and stores it as a correlated in-window pattern 602.

Referring again to FIG. 7, denoted 502 is second image information obtained by the optical sensor unit 16 detecting the surface within the image capturing area of the print medium being conveyed at time T2 different from T1. The controller successively moves the correlated window region on the second image information to detect a position where it matches the correlated in-window pattern 602 that is already stored. Then, based on a distance L between the position of the correlated in-window pattern 602 in the first image information 501 and the position of the correlated in-window pattern 602 in the second image information 502, a distance that the print medium 8 has moved between time T1 and time T2 is determined considering an optical magnification of the lens 43. From a time difference between T1 and T2, the conveying speed of the print medium 8 can also be calculated.

In the above example, for simplicity of explanation, the measurement of the distance traveled by the print medium has been described to be performed by referring to a cross pattern printed on the print medium. However, referring again to FIG. 2, the optical sensor unit 16 of this embodiment is disposed upstream of the carriage 2 in the conveying direction and located at an almost central part in the main scan direction. Therefore, the information on the print medium after having been printed cannot be obtained. In this embodiment, the optical sensor unit 16 detects the surface state of a blank print medium 8 or belt 15. More specifically, when the print medium 8 has passed the paper sensor 33 and is within a range in which it can be detected by the optical sensor unit 16, the surface state of the print medium 8 is detected. When the print medium 8 is outside the detectable range, the surface state of the belt 15 is detected. In either case, by binarizing the signal that the optical sensor unit 16 has received and converting it into a pattern, the conveying distance and speed of the print medium 8 and belt 15 can be determined by the method described referring to FIG. 7 and FIG. 8. In the method that measures the conveying distance by using the rotation angle sensor 18, the conveying distance is determined at the timing when a slit is detected. With the method using such an optical sensor unit 16, the actual conveying distance and speed can be obtained for each unit time.

In this embodiment, while the optical sensor unit 16 is used to measure the conveying distance of the print medium according to the steps explained in FIG. 7 and FIG. 8, it is also possible to use the detection value of the optical sensor unit 16 to decide the presence or absence of the print medium.

Figure 9:
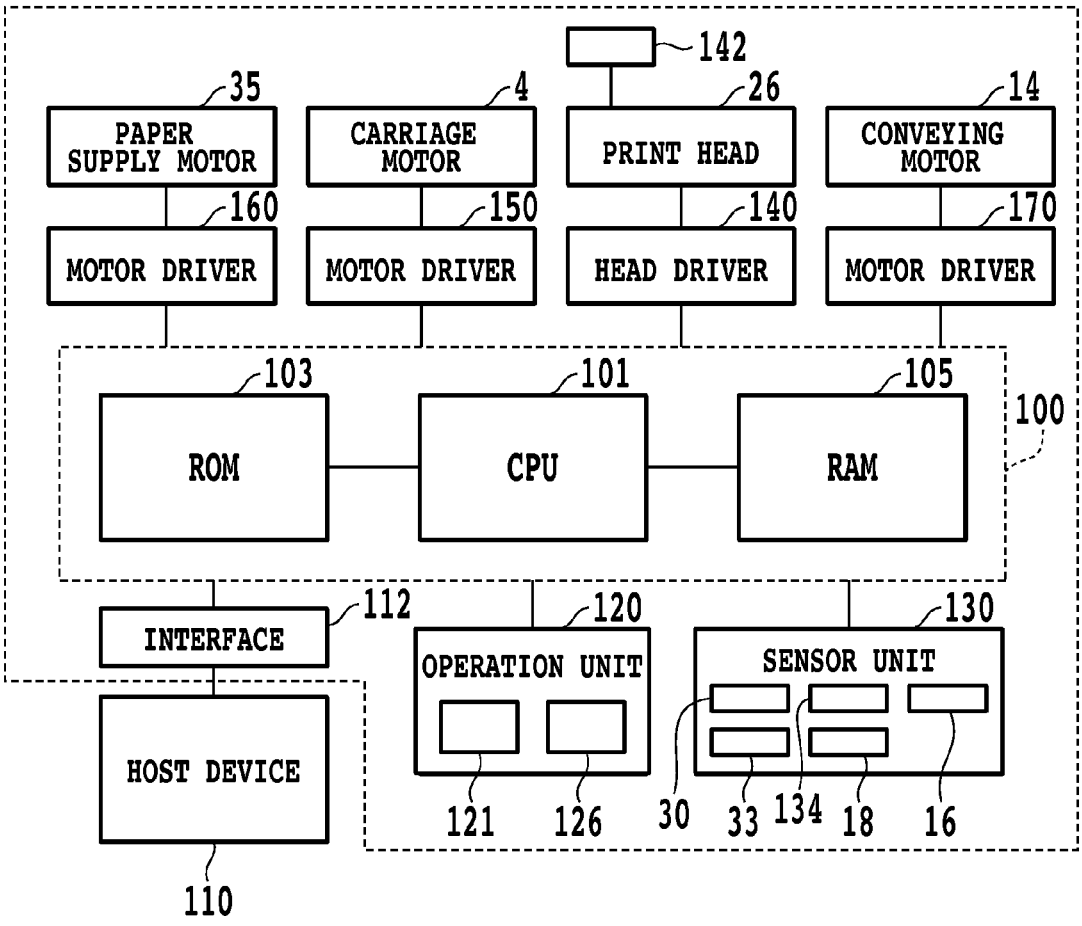
FIG. 9 is a block diagram showing a control configuration in the ink jet printing apparatus applied to one embodiment of this invention.

FIG. 9 is a block diagram showing a control configuration in the ink jet printing apparatus as applied to this embodiment. In the figure, a controller 100 is a main control unit of the printing apparatus and has, for example, a CPU 101 in the form of a microcomputer, a ROM 103 storing programs, associated tables and other fixed data, and a RAM 105 containing areas in which to develop image data and also work areas.

A host device 110 is an externally connected device that functions as an image source for the printing apparatus. The host device 110 may be a computer that generates or processes data such as images to be printed or a reader unit that reads images. Image data and other commands supplied from the host device 110 and status signals can be transferred to and from the controller 100 through an interface (I/F) 112.

An operation unit 120 has a group of switches to accept input commands from an operator, including a power switch 122 and a recovery switch 126 to initiate a suction-based recovery operation.

A sensor unit 130 has a group of sensors to detect the state of the printing apparatus. This embodiment has a temperature sensor 134 to detect an ambient temperature, in addition to the above-described home position sensor 30, the paper sensor 33, and the optical sensor unit 16 and rotation angle sensor 18 for detecting the conveying distance.

Denoted 140 is a head driver that drives the electrothermal transducing elements 25 of the print head 26 according to the print data. The head driver 140 has a shift register to align the print data so as to match the associated electrothermal transducing elements 25, and a latch circuit that latches data at an appropriate timing. The head driver 140 also includes a logic circuit device that triggers the electrothermal transducing elements 25 in synchronism with the drive timing signal and a timing setting unit that appropriately sets the ejection timing to adjust the dot positions on the print medium.

A subheater 142 to adjust the temperature of the print head 26 to stabilize the ink ejection characteristic is installed near the print head 26. The subheater 142 may be formed on the substrate of the print head 26, like the electrothermal transducing elements 25, or attached to the body of the print head 26 or the head cartridge 1.

Denoted 150 is a motor driver to drive the carriage motor 4, 160 a motor driver to drive the paper supply motor 35, and 170 a motor driver to control the conveying motor 14.

Figure 10:
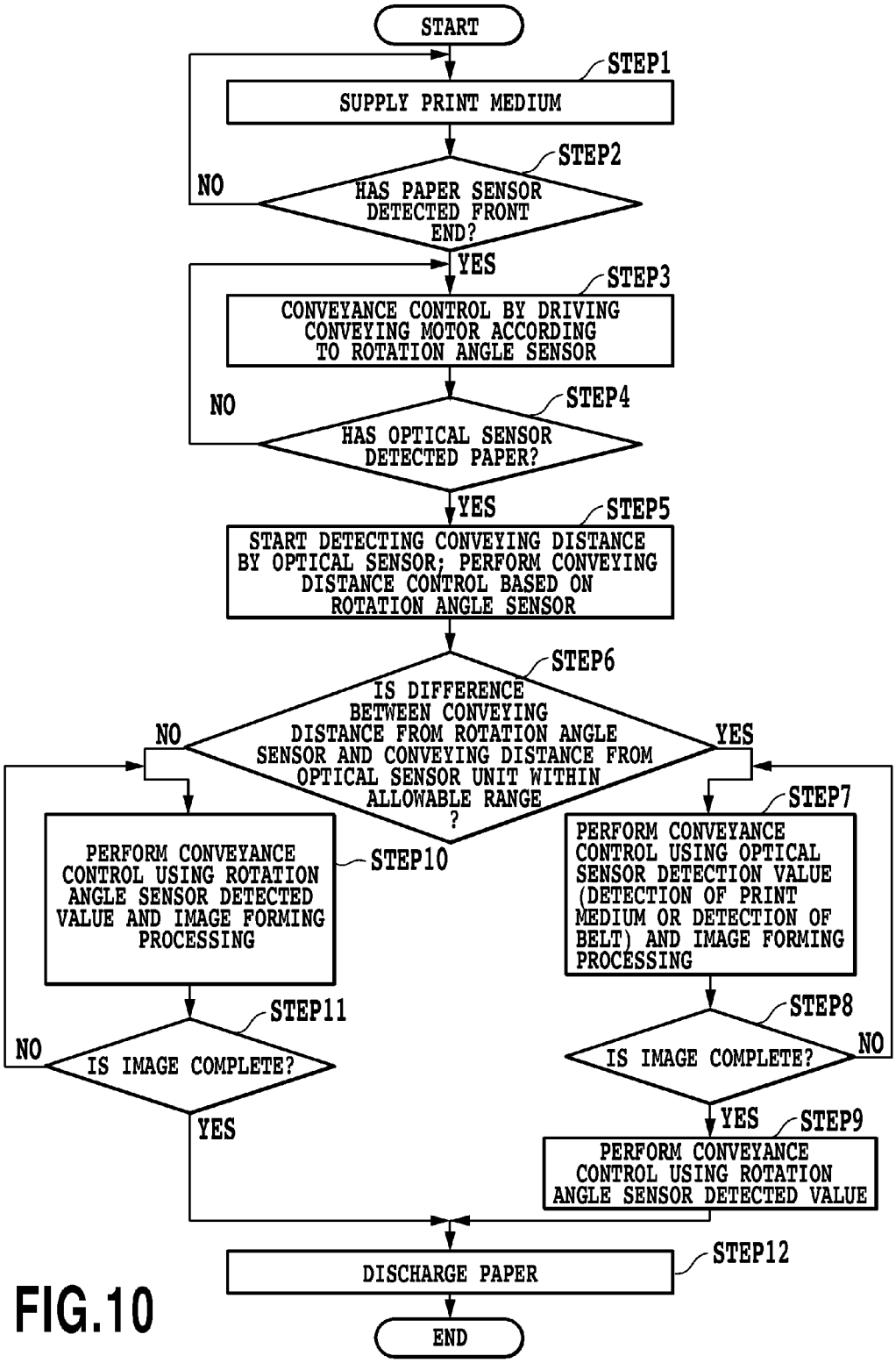
FIG. 10 is a flow chart showing a sequence of steps performed by the CPU in the print medium conveyance control in a first embodiment.
Figure 11:
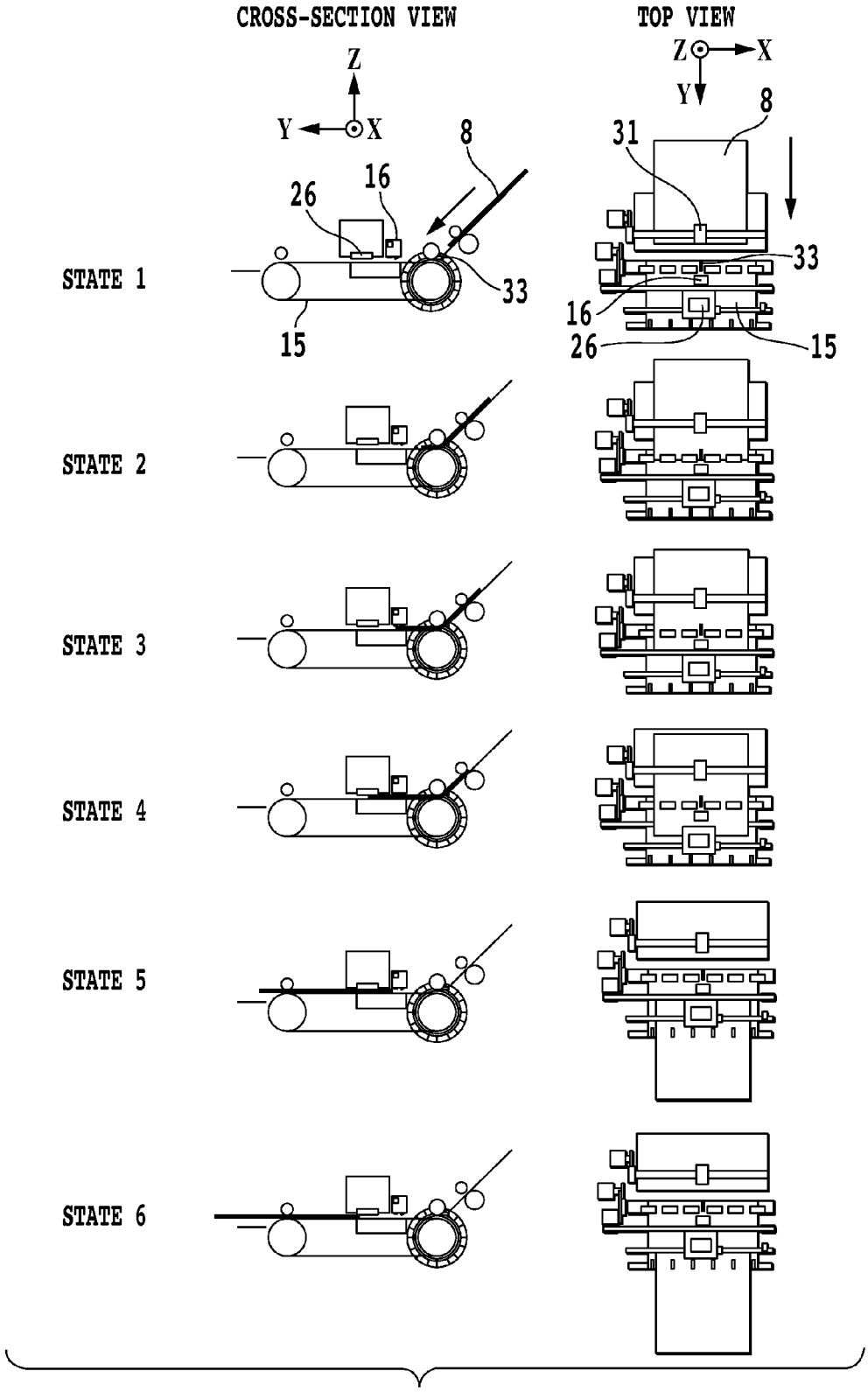
FIG. 11 shows the state of the print medium being conveyed at each step of the flow chart of FIG. 10.

FIG. 10 is a flow chart showing a sequence of steps that the CPU 101 performs in the print medium conveyance control of this embodiment. FIG. 11 shows states of the print medium being conveyed at different steps of the flow chart. In this embodiment a "marginless printing" is performed which forms an image over an entire area of the print medium from its front end to the rear end.

When the print operation is started by a print start command from the host device 110, the CPU 101 operates the paper supply motor 35 to supply one sheet of the print medium 8 from the auto sheet feeder 32 (step 1, state 1). In the next step 2, the CPU 101 checks whether the paper sensor 33 has detected the front end of the print medium 8. If it is found that the front end of the print medium 8 has been detected, the CPU 101 moves to step 3. If it is found that the front end of the print medium has not yet been detected in the step 2, the CPU 101 returns to step 1 where it continues the paper supply operation. Until the front end of the print medium is detected, step 1 and step 2 are repeated. State 2 of FIG. 11 shows that the front end of the print medium 8 has just reached a position where it can be detected by the paper sensor 33.

In step 3 the CPU 101 starts to drive the conveying motor 14 and at the same time starts the detection by the rotation angle sensor 18 of the rotational amount of the code wheel 13. As a result, the print medium 8 is placed on the belt 15 and the print medium conveyance control in the Y direction is performed based on the information from the rotation angle sensor 18. More specifically, the CPU 101 determines the amount and speed of rotation of the conveying roller 9 from the timing at which the rotation angle sensor 18 detects the slit cut in the code wheel 13. These measured values are fed back to the conveyance control that controls the conveying motor 14.

In the next step 4, the CPU 101 checks whether the optical sensor unit 16 has detected the print medium 8. If it decides that the print medium 8 has been detected, the CPU 101 moves to step 5. If not, the CPU 101 returns to step 3 and repeats step 3 and step 4 until the optical sensor unit 16 detects the print medium 8. The state 3 of FIG. 11 represents the conveying state of a timing at which the front end of the print medium 8 has reached the region detectable by the optical sensor unit 16.

In step 5 the CPU 101 starts measuring the conveying distance using the optical sensor unit 16. It is noted, however, that at this timing, the CPU 101 does not perform the conveyance control based on the information from the optical sensor unit 16 but controls the conveying motor 14 by feeding back only the information from the rotation angle sensor 18. The CPU 101 stores the conveying distance information from the rotation angle sensor 18 and the conveying distance information from the optical sensor unit 16, obtained at the same timing.

In step 6, the CPU 101 checks if a difference between the conveyance information from the rotation angle sensor 18 and the conveyance information from the optical sensor unit 16 is within an allowable range. If the difference is within the allowable range, the CPU 101 moves to step 7. If not, the CPU moves to step 10.

In step 7, the CPU 101 switches the information for the print medium conveyance control from the conveyance information from the rotation angle sensor 18 to the conveyance information from the optical sensor unit 16 and starts the printing operation according to the image data. That is, based on the conveyance information obtained from the optical sensor unit 16, the CPU 101 determines the conveying distance and speed of the print medium 8 and feeds back these actually measured values to the conveyance control of the conveying motor 14 as it executes the printing operation using the print head 26. In this embodiment, since the "marginless printing" that prints an image to the edges of the print medium 8, the printing operation on the print medium 8 by the print head 26 is started at the position of state 4 of FIG. 11, followed by state 5, and ended at the position of state 6. In state 4, the optical sensor unit 16 detects the conveying distance of the print medium 8. But in state 5 the rear end of the print medium 8 moves out of the detectable range of the optical sensor unit 16. In this embodiment, therefore, what the optical sensor unit 16 is detecting between state 5 and state 6 is not the print medium 8 but the belt 15. As described above, if the object being detected is changed in the middle of the detection operation, the measurement of the conveying distance by the optical sensor unit 16 can be made without interruption as long as the print medium 8 is conveyed on the belt 15 as in this embodiment.

In step 8, the CPU 101 checks if the printing of all image data on the print medium 8 is completed. If it decides that the printing of all image data is completed, the CPU moves to step 9 where it continuously conveys the print medium by the conveyance control using the rotation angle sensor 18. Then at step 12, it performs a paper discharging operation before exiting this processing. If at step 8 it is decided that the printing of image data on the print medium 8 is not yet completed, the CPU 101 returns to step 7 where it performs the conveyance control based on the information from the optical sensor unit 16 while at the same time continuing the printing operation.

In step 6 if it is decided that the difference between the conveyance information from the rotation angle sensor 18 and the conveyance information from the optical sensor unit 16 is greater than the allowable level, the CPU 101 starts the printing operation while remaining in the conveyance control based on the information from the rotation angle sensor 18 (STEP 10). When the difference between two pieces of conveyance information is greater than the allowable level, a priority is given to the information from the rotation angle sensor 18. This is because, depending on the kind of print medium used, the detection of the conveying distance based on the optical sensor unit 16 may be difficult to perform and the reliability of the conveying distance information obtained may be degraded. On the contrary, when the rotation angle sensor 18 is used, although the actual distance traveled by the print medium is not measured, it is known that the information from the rotation angle sensor 18 does not differ so much from the actual distance traveled. This means that the reliability of this information obtained is high.

In step 11 the CPU 101 checks if the printing of all data on the print medium 8 is complete. If it is decided that all image data has been printed, the CPU moves to step 12 where it performs a paper discharging operation, before exiting this processing. If step 11 decides that the printing of all image data on the print medium 8 is not yet completed, the CPU returns to step 10 where it performs the conveyance control based on the information from the rotation angle sensor 18 while at the same time continuing the printing operation.

With this embodiment described above, if the object being detected is changed from the print medium to the belt in the middle of the detection operation, the measurement of the conveying distance by the same detection method using the same optical sensor unit can be performed without interruption. It is therefore possible to detect the conveying distance of the print medium with high reliability in the entire process of conveying the print medium as it is printed and, by using the detected information, to execute the conveyance control with high precision.

(Second Embodiment)

In this embodiment too, the printing apparatus and the print head similar to those of the first embodiment are used. It is noted, however, that the printing apparatus of this embodiment does not include the construction for measuring the rotational amount of the conveying roller 9, i.e., the code wheel 13 and the rotation angle sensor 18.

In the first embodiment, the printing apparatus and the conveyance control method have been described to have the rotation angle sensor 18 in addition to the optical sensor unit 16 in order to deal with a situation where the reliability of the conveying distance information from the optical sensor unit 16 deteriorates. However, the provision of the rotation angle sensor 18 or the provision of other means than the optical sensor unit 16 to detect the conveying distance of the print medium is not essential in this invention. If the optical sensor unit 16 can detect almost precisely the conveying distance of most of the print medium that the printing apparatus is designed to accept, the conveyance control may be executed by using only the conveyance information from the optical sensor unit 16 in the entire process of conveying the print medium being printed.

Figure 12:
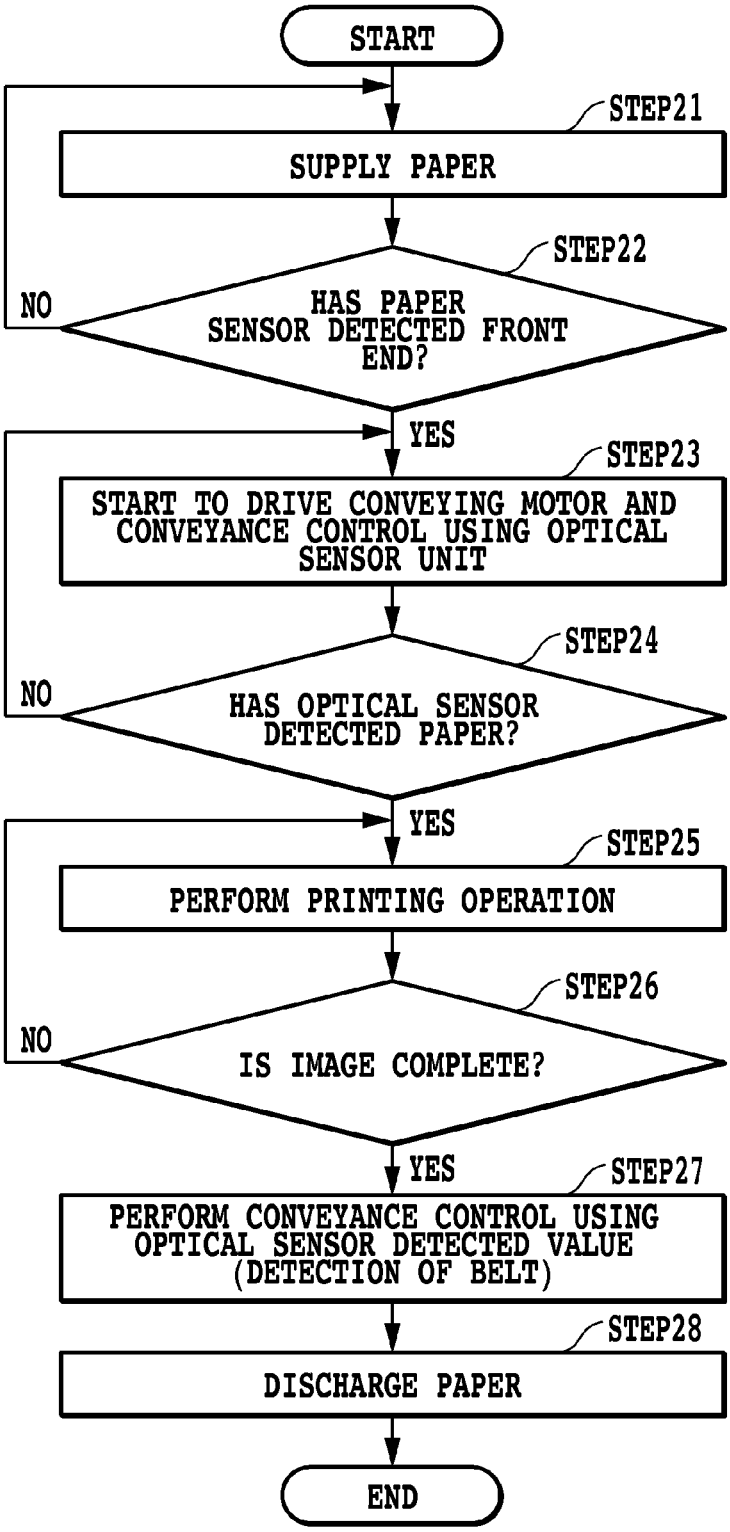
FIG. 12 is a flow chart showing a sequence of steps performed by the CPU in the print medium conveyance control in a second embodiment.

FIG. 12 is a flow chart showing a sequence of steps that the CPU 101 performs in the print medium conveyance control in this embodiment. Characteristic portions of this embodiment different from the flow chart of FIG. 9 will be explained.

In step 22 when the paper sensor 33 detects the print medium 8, the CPU 101 moves to step 23 where it starts to drive the conveying motor 35 under the conveyance control using the optical sensor unit 16. At this point in time, since the front end of the print medium 8 has not reached the detectable region of the optical sensor unit 16, the object that the optical sensor unit 16 is detecting is the belt 15.

In step 24, when the optical sensor unit 16 detects the print medium 8, the CPU 101 moves to step 25 where it starts the printing operation under the conveyance control using the optical sensor unit 16. When the optical sensor unit 16 detects the print medium 8, the object being detected by the optical sensor unit 16 switches from the belt 15 to the print medium 8. Then the printing operation by step 25 is repeated until step 26 decides that all image data has completely been printed on the print medium 8.

When step 26 confirms that the printing of all image data is completed, the CPU 101 moves to step 27 where it conveys the print medium 8 under the conveyance control using the optical sensor unit 16. In step 28 the printed medium is discharged. Now, the processing is ended.

With this embodiment described above, the provision of only one conveying distance measuring means (optical sensor unit) makes it possible to detect the conveying distance of the print medium with high reliability in the entire process of conveying the print medium as it is printed and, by using the detected information, to execute the conveyance control with high precision.

(Third Embodiment)

In this embodiment too, the printing apparatus and print head similar to those of the first embodiment are used. This embodiment, however, performs a basic conveyance control using the conveying distance information from the rotation angle sensor 18 and makes correction to the conveyance control according to the conveying distance information from the optical sensor unit 16.

Figure 13:
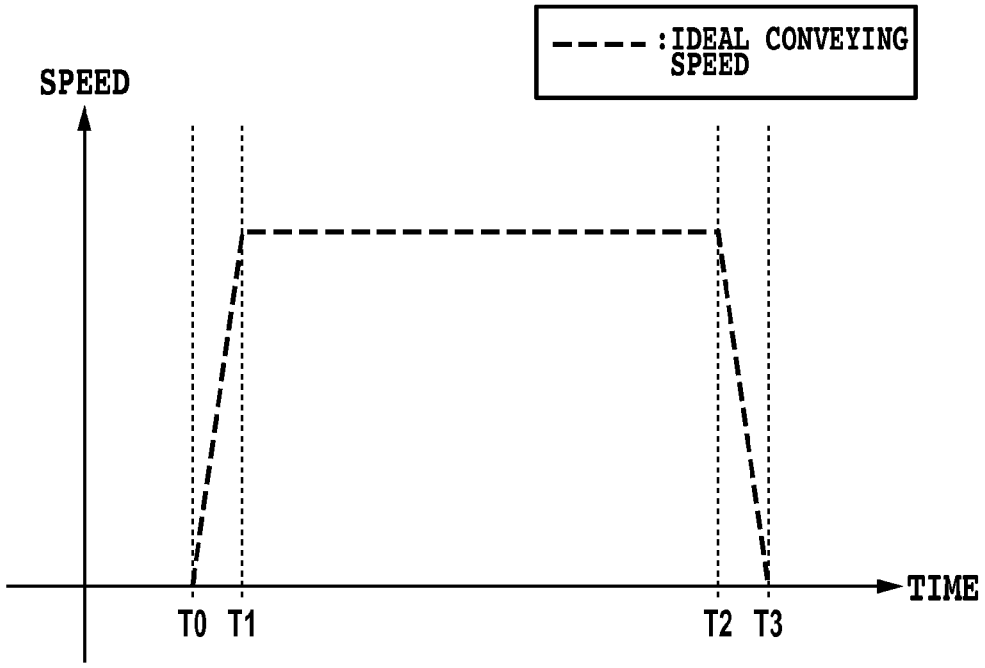
FIG. 13 is a graph showing an ideal conveying speed of a belt (print medium) with respect to time, when one conveying operation is done by the conveying motor.

FIG. 13 shows an ideal conveying speed of the belt 15 (print medium 8) with respect to time, when one conveying operation is performed by the conveying motor 14. In the figure, an acceleration control is performed from T0 to T1, a constant speed control is done from T1 to T2, and a deceleration control is done from T2 to T3. However, when some external forces are applied to the conveying system, the movement of the belt 15 may not follow the operation of the conveying motor 14.

Figure 14:
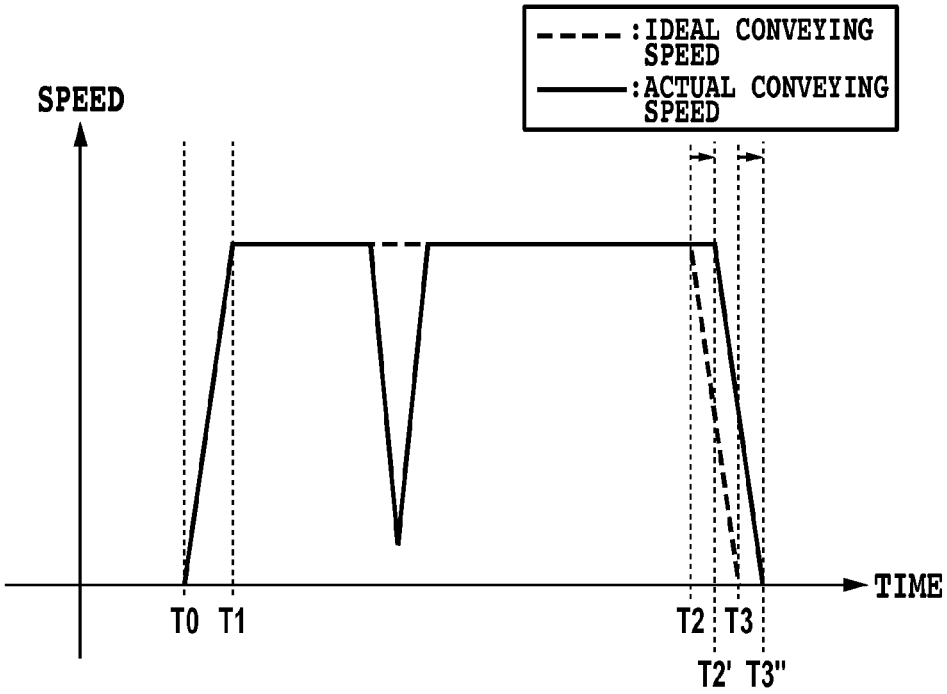
FIG. 14 shows a method of correction used when the conveying speed of the belt fails to be an ideal in one conveying operation.

FIG. 14 shows a correction method used when the conveying speed of the belt 15 fails to be an ideal state in one conveying operation. In the constant speed control between T1 and T2, when the speed of the print medium temporarily falls as shown in the figure, the execution of the normal deceleration control as indicated by a dashed line, i.e., a constant deceleration control between T2 and T3, can make the conveying distance of the print medium 8 smaller than a target. Therefore in this embodiment, based on the conveying distance information from the optical sensor unit 16, the timing T2 at which the constant speed control is changed to the deceleration control is adjusted for each conveying operation. FIG. 14 shows an example in which T2 is corrected to T2'. As described above, by delaying the timing at which to switch from the constant speed control to the deceleration control, the timing at which the conveying speed of the print medium is 0 is corrected from T3 to T3'. As a result, conveying distance of the print medium 8 can be made to approach the target value.

While the target conveying distance has been described here to be realized by correcting the timing T2 at which to switch from the constant speed control to the deceleration control, the parameter to be corrected for the adjustment of the conveying distance is not limited to T2. For example, the target conveying distance may be achieved by leaving as is the timing T2 at which to switch from the constant speed control to the deceleration control and moderating the deceleration degree (inclination from T2 to T3).

In the above embodiment, the optical sensor unit 16 has been described to be installed upstream of the carriage 2. In this invention, however, there is no particular limitation on the installation position of the optical sensor unit 16. The only requirement is that the detection region of the optical sensor unit 16 be an area that the print medium passes and be an area before or after passing of the print medium where there is the belt that mounts and carries the print medium.

In this embodiment, the optical sensor unit needs to be able to detect surfaces of both the print medium and the belt. So, a charging mechanism to generate static electricity between the print medium and the belt being conveyed to attract them together or a discharging mechanism to remove the static electricity may be installed inside the printing apparatus. To prevent the conveying system other than the belt, such as pickup rollers, from interfering with the print medium conveying operation of the belt, a mechanism may be provided to bring the pickup rollers out of contact with the print medium immediately after the print medium is supplied.

Further, the surface of the belt may be provided with a pattern or fine undulations so that an image detected by the optical sensor unit easily shows its characteristic features.

For the comparison of characteristic of an image detected by the optical sensor unit, a patterned image, such as shown in FIG. 7 or FIG. 8, may be used. This invention, however, is not limited to these patterns. For example, information of reflected light from the optical sensor unit may be Fourier-transformed and information obtained at different timings may be compared for match at each frequency. It is also possible to obtain the conveying distance of only a part corresponding to a peak.

Although the serial type ink jet printing apparatus has been described, this invention is not limited to the above constructions. The print head may be other than the ink jet type. The effect of this invention can also be fully realized if the printing apparatus is a full-line type printing apparatus in which the ejection openings are arrayed in an X direction over a length corresponding to the width of the print medium and in which the print medium is conveyed continuously for image printing.

Although the above explanation has taken for example a printing apparatus that prints on commonly used print medium, this invention has no limitation on the print medium used. This invention can effectively be applied to any objects, such as leather, cloth, pottery and plastics, whose surface can be applied with ink to form an image thereon.

In either construction, the effect of this invention can be fully realized as long as the printing apparatus has an object as a print medium, a belt to convey the print medium in contact with it, and a detecting unit to detect conveying distances of both the print medium and the belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-169047, filed Jun. 27, 2008, which is hereby incorporated by reference herein in its entirety.

What is claimed is:

1. A printing apparatus for printing an image on a print medium, comprising:

a printing unit;

a belt capable of holding the print medium thereon;

a drive mechanism configured to move the belt while printing;

a detecting unit including an image capturing device that is located upstream of the printing unit in a moving direction of the print medium, said detecting unit configured for the image capturing device to capture an image of the belt and an image of the printing medium held on the belt, and said detecting unit being capable of detecting a leading end of the print medium in the moving direction of the print medium by the image capturing device; and a control unit configured to control said drive mechanism and said printing unit and to acquire the moving distance or the speed of the print medium held on said belt based on the image captured by the image capturing device, wherein said control unit controls so as to start acquisition of the moving distance or the speed of the print medium and start performance of a printing operation by the printing unit, after the detection by the detecting unit of the leading end of the print medium held on said belt.

2. The printing apparatus according to claim 1, wherein an image capturing area of said image capturing device is on the belt surface where the print medium on the belt passes through.

3. The printing apparatus according to claim 2, wherein, while printing, when the print medium exists in the image capturing area, said image capturing device captures the surface image of the print medium and, when the print medium does not exist in the image capturing area, said image capturing device captures the surface image of the belt.

4. The printing apparatus according to claim 2, wherein said image capturing device is provided at a position upstream of a print area with respect to a moving direction of the print medium while printing.

5. The printing apparatus according to claim 1, further comprising:

a sensor configured to acquire a moving distance or a speed of the print medium by measuring a drive amount of said drive mechanism;

wherein said control unit controls said drive mechanism based on detection outputs of said detecting unit and said sensor.

6. The printing apparatus according to claim 5, wherein said control unit controls said drive mechanism according to the detection output of said sensor which has been corrected by the detection output of said detecting unit.

7. The printing apparatus according to claim 5, wherein said control unit determines a difference between the detection output of said detecting unit and the detection output of said sensor;

wherein, according to whether the difference is within an allowable level, said control unit controls said drive mechanism based on the detection output of said detecting unit or controls said drive mechanism based on the detection output of said sensor.

8. The printing apparatus according to claim 5, wherein said drive mechanism has a conveying roller to transmit its rotation motion to the belt;

wherein said sensor detects a rotational amount of the conveying roller to acquire the moving distance or moving speed of the print medium.

9. The printing apparatus according to claim 1, wherein said detecting unit comprises an optical sensor having a light emitting element and the image capturing device, the image capturing device receiving light reflected from the surface of the belt or the print medium;

wherein said detecting unit acquires the moving distance or moving speed of the print medium by multiple detections at different timing.

10. The printing apparatus according to claim 9, wherein the image capturing device is a CCD device or a CMOS device arranged one-dimensionally or two-dimensionally.

11. The printing apparatus according to claim 1, wherein said control unit ceases to acquire the moving distance or the speed of the print medium after the printing of the print medium held on said belt is completed.

12. The printing apparatus according to claim 1, wherein the image capturing device of said detecting unit captures an image upstream of a printing area of said printing unit with respect to the moving direction of the printing medium.

* * * * *